United States Patent [19]

Goerens

[11] 3,995,419

[45] Dec. 7, 1976

[54] EAR-SHAPED RING TRAVELERS FOR YARN TWISTERS

[75] Inventor: Robert L. Goerens, Esch sur Alzette, Luxembourg

[73] Assignee: Uniroyal Luxembourg S.A., Steinfort, Luxembourg

[22] Filed: June 19, 1975

[21] Appl. No.: 588,252

[30] Foreign Application Priority Data

Apr. 7, 1975 Germany ..... 2515097

[52] U.S. Cl. ..... 57/125

[51] Int. Cl.[2] ..... D01H 7/60

[58] Field of Search ..... 57/119–125

[56] References Cited

UNITED STATES PATENTS

| | | | |
|---|---|---|---|
| 631,342 | 8/1899 | Tetlow | 57/125 |
| 1,937,676 | 12/1933 | Wentworth | 57/125 |
| 2,111,544 | 3/1938 | Bassett | 57/125 |
| 2,111,545 | 3/1938 | Bassett | 57/125 |
| 2,116,071 | 5/1938 | Kempton | 57/125 |
| 2,118,873 | 5/1938 | Wentworth et al. | 57/125 |
| 2,121,647 | 6/1938 | Wentworth | 57/125 |

FOREIGN PATENTS OR APPLICATIONS

| | | | |
|---|---|---|---|
| 13,972 | 8/1956 | Germany | 57/125 |

*Primary Examiner*—John Petrakes
*Attorney, Agent, or Firm*—Norbert P. Holler

[57] ABSTRACT

A generally ear-shaped ring traveler, designed for movement with minimized ring to traveler friction and aerodynamic resistance along the inside of a ring of a yarn twister or like machine, is disclosed. The cross-sectional configuration of the traveler at any given transverse plane is characterized by an oblong shape having a relatively wider or blunt leading edge and a relatively narrower or less blunt trailing edge, with the cross-section being airfoil-shaped in the main body section and in each of the upper and lower transverse arms so as to cause lift forces opposing the yarn forces and the centrifugal force to be generated, and generally drop-shaped in the transition regions between the arms and the main body section so as to provide a generally neutral streamlining effect. This abstract is not to be taken either as a complete exposition or as a limitation of the present invention, however, the full nature and extent of the invention being discernible only by reference to and from the entire disclosure.

9 Claims, 7 Drawing Figures

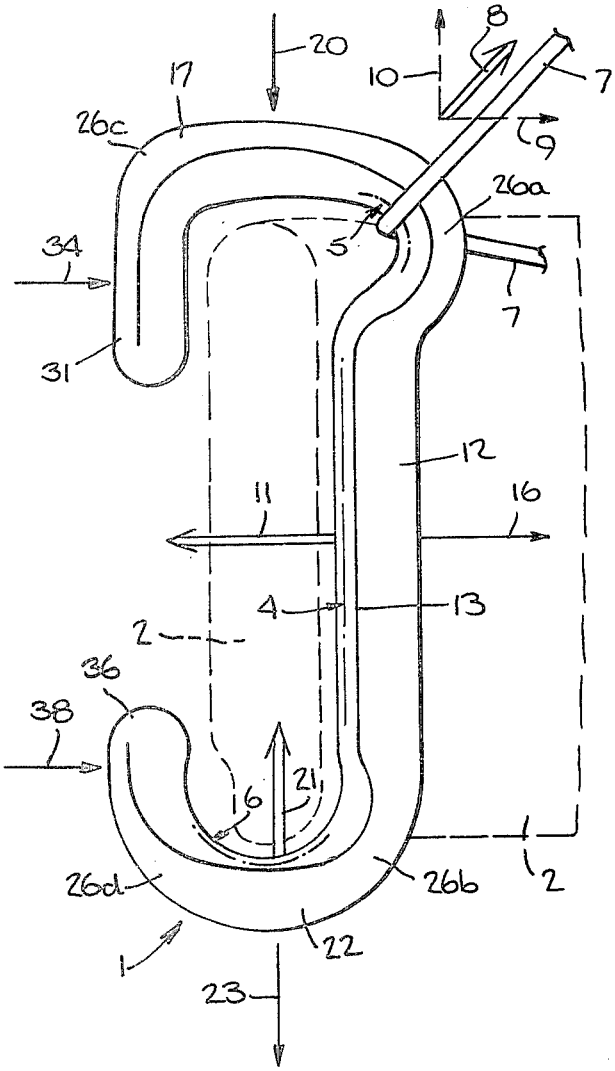
Fig. 1.
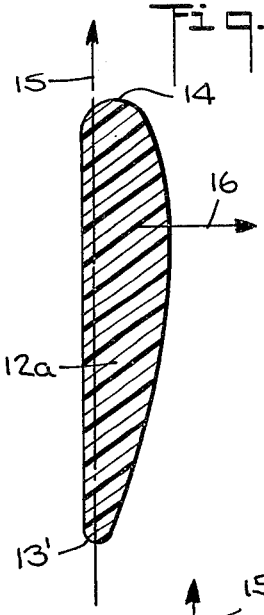
Fig. 2.
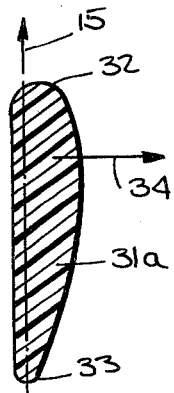
Fig. 5.
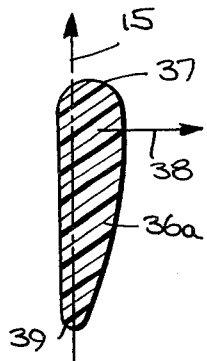
Fig. 6.
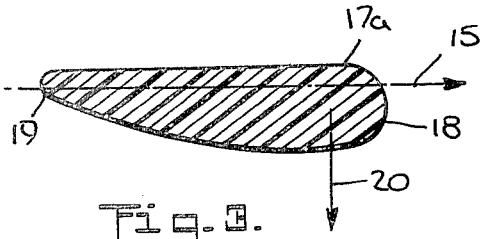
Fig. 3.
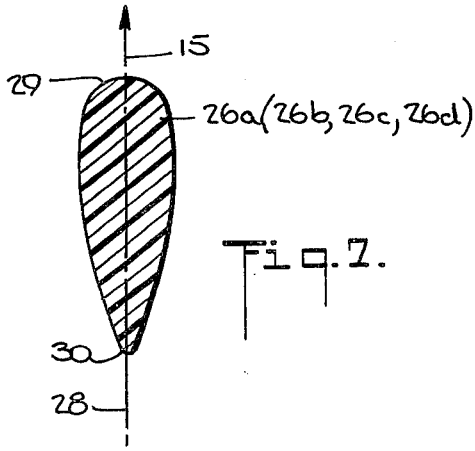
Fig. 7.
Fig. 4.
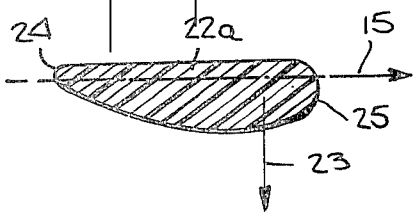

EAR-SHAPED RING TRAVELERS FOR YARN TWISTERS

This invention relates to ring travelers for yarn spinning or twisting machines, and in particular to an ear-shaped traveler designed for movement in a single given direction along the ring of such a machine.

Travelers for ring twisters and like machines are conventionally designated as either ear-shaped or C-shaped. By way of definition, an ear-shaped traveler is one which in use has a primarily straight main body or mid-section extending generally vertically across and traveling along the inside face of the circular ring, and two end sections or arms extending codirectionally generally transversely to the main body section and outwardly therefrom over the top and bottom edges of the ring, respectively, with the arms terminating in a pair of inwardly directed hook-like ends engaging the outside face of the ring to retain the traveler thereon despite its laterally open construction, and with the traveler being somewhat recessed at the juncture between the main body section and the upper arm thereof to define a guide through which the yarn passes as, by virtue of the concurrent uniform up and down motion of the ring relative to the bobbin, it is helically wound on the bobbin while being at the same time subjected to the desired torsion or twist. A C-shaped traveler, on the other hand, is one which in use has a primarily arcuate main body section extending generally horizontally across and traveling along the top edge of the ring, the body section terminating in two inwardly directed hook-like ends engaging, respectively, under the inner and outer peripheral top edge flanges of the ring to retain the traveler on the ring, and the yarn passing under the said body section on its way to the bobbin.

Merely by way of example, a number of known ear-shaped travelers which are representative of the various constructions developed over the years are disclosed in U.S. Pat. Nos. 631,342 and 1,937,676, and in German Pat. No. 958,908 and OLS No. 2,224,935.

When such a traveler runs along the ring at high speeds, different forces act on the traveler. On the one hand, there are the forces resulting from the tension of the yarn, which forces have components directed horizontally inwardly of the ring, i.e. toward the center or the axis of the ring, as well as components directed vertically upwardly relative to the ring. On the other hand, the traveler is subjected to forces directed radially outwardly of the ring, i.e. the centrifugal forces resulting from the movement of the traveler along the ring. As a function of the relationship of the forces bearing upon the traveler, therefore, the traveler has predetermined zones facing the ring which are subject to increased loads and, hence, to greater wear. Moreover, the circular motion of the traveler along the ring takes place against a substantial air resistance.

It has been proposed in the art (see, for example, U.S. Pat. Nos. 2,111,544 and 2,111,545) that the air resistance of a ring traveler may be reduced essentially by providing the traveler with a cross-sectional configuration which is streamlined with respect to the direction of movement of the traveler in such a way that the traveler while in motion behaves aerodynamically as favorably as possible. To the same end, it has also been proposed to utilize a cross-sectional configuration which is either drop-shaped or airfoil-shaped, as shown, for example, in a withdrawn German Patent Application No. Sch 13972 VII/76c, published Aug. 16, 1956. Still further, it has been proposed (see, for example, U.S. Pat. No. 2,116,071) that the tilting tendency of the traveler resulting from the tension of the yarn may be counteracted by a corresponding distribution of the weight of the traveler in such a way that the major portion of the weight is provided at one side of the traveler standing in a predetermined relation to the tension of yarn.

The various prior art constructions so far discussed have, however, not been fully satisfactory in terms of maximizing the possible rotational speed of movement of the traveler. To enable such an increase in the traveler speed and a corresponding increase in the operating speed of ring spinning and twisting machines to be attained, I have proposed in my prior copending application, Ser. No. 451,297, filed Mar. 14, 1974 and assigned to the same assignee as the instant application, a basic construction for an ear-shaped traveler designed for movement in a single given direction along the ring, which construction is characterized by a cross-sectional configuration which in all essential transverse planes has an oblong shape provided with a wider or blunt leading edge and a relatively narrower or less blunt trailing edge. As disclosed in the said prior application, within that concept the shape of the cross-sectional configuration may be airfoil-like, drop-like or even generally elliptical. Reference may be had to said prior application for further details.

The present invention represents a modification of the aforesaid basic construction. In particular, it is the object of the present invention to provide a novel and improved traveler of the type described above which is so constructed that the ring-engaging contact areas of the traveler which are subject to greater wear under the effects of the forces acting on the traveler, are largely relieved from the forces causing the pressing of the traveler at such contact areas into engagement with the ring, so that even in the case of very high running speeds and concomitant high forces, there occurs only minor wear and the traveler moves under an optimally low load.

In accordance with the present invention, these objectives are attained by a traveler construction characterized (a) in the main body section thereof juxtaposed to the inside of the rail, by a lift-generating cross-sectional configuration that counteracts the effects of centrifugal force, and (b) in the two transverse arms above and beneath the ring by cross-sectional configurations which jointly counteract the effects of the yarn tension forces. Advantageously, the cross-sectional configurations at least in the transition areas between the main body section and the arms of the traveler, and normally also in the transition sections between the arms and the respective extremities or hook ends of the arms, are designed to be neutral insofar as lift is concerned but still aerodynamically streamlined. The cross-sectional configurations of the hook ends of the traveler arms engaging the ring on the outside can be designed to be similarly neutral. Advantageously, however, the arm ends will also have cross-sectional configurations designed to generate lift forces directed toward the center of the ring. In all cases, of course, the cross-sectional configuration will have the hereinbefore mentioned oblong shape characterized by a blunt or relatively wider leading edge (as viewed in the intended direction of movement of the traveler) and a less blunt or relatively narrower trailing edge.

Through the construction of the traveler in accordance with the principles of the present invention, those ring-engaging regions of the traveler which are subjected to the greatest loads, i.e. principally the outwardly facing inside of the main body section and the upwardly facing inside of the lower arm of the traveler, are optimally relieved from the effects of friction generated between these regions and the ring, so that even at very high operating speeds, the traveler has a substantially longer life. At the same time, the traveler profiles provided in accordance with the present invention reduce considerably the air resistance which opposes the movement of the traveler along the ring.

The foregoing and other objects, characteristics and advantages of the present invention will be more clearly understood from the following detailed description thereof when read in conjunction with the accompanying drawing, in which:

FIG. 1 is a rear elevational view (with respect to its direction of movement) of an ear-shaped traveler in accordance with the present invention, the traveler being shown in operating relation to a spinning or twisting machine ring (shown in broken lines only);

FIGS. 2 to 6 illustrate the lift-generating profiles or cross-sectional configurations of the main body section, the upper and lower arms, and the upper and lower hook ends of the traveler; and FIG. 7 similarly illustrates the neutral profile or cross-sectional configuration of the transition sections between the main body section and the arms of the traveler.

Referring now to the drawing in greater detail, the ear-shaped traveler 1 shown in FIG. 1 exhibits, as viewed from behind in its direction of movement, the profile customary for such travelers. Thus, the traveler 1 has a main body section 12, transverse upper and lower arms or end sections 17 and 22, the arms terminating in respective mutually inwardly directed hook-like ends 31 and 36, respective transition sections 26*a* and 26*b* between the main body section and the arms 17 and 22, and respective transition sections 26*c* and 26*d* between the arms and the hook ends 31 and 36. At the juncture of the main body section 12 and the upper arm 17, the traveler is formed with an arcuate recessed region to define the guide space through which the yarn to be twisted will pass. When the traveler is in use, the main body section of the traveler extends generally vertically across and moves translationally along the radially inner face of the ring 2 (shown in phantom outline only). At the same time, the upper and lower arms extend generally horizontally across and move translationally along the upper and lower edges, respectively, of the ring, and the hook-like ends extend in over and move translationally along the ring at the outside face thereof and prevent the traveler from falling off the ring. In FIG. 1, it will be understood, the center of the ring 2 is situated to the right-hand side of the traveler.

In FIG. 1, the three regions 4, 5 and 6 of the traveler that are particularly subject to wear are denoted by dot-dash lines. Of these, the region 4 is the inside surface of the main body section 12 which, as a result of centrifugal force, indicated by the double-line arrow 11, acting upon the traveler 1 when the same is moving at a high speed, is pressed against the inside face of the ring 2. The region 5 is the inside surface of the recessed transition section between the main body section 12 and the upper arm 17, against which surface the yarn 7 rubs while being guided, essentially under a tension indicated by the double-line arrow 8, to the bobbin or taken-up spool (not shown). Because of the tension on the yarn, there is exerted onto the traveler a force having a component 9 directed toward the center of the ring and a component 10 directed upwardly relative to the ring. The region 6 is the inside surface of the lower arm 22 where the traveler, under a force indicated by the double-line arrow 21, tends to be pulled against and to rub frictionally along the bottom edge of the ring by the raising of the traveler under the effect of the component 10 of the yarn force.

It will be seen that, as an abstract proposition, the yarn force component 9, being directed oppositely to the centrifugal force 11, is capable of partially counteracting the effects of centrifugal force. In practice, however, since by virtue of the location of the transition section 26*a*, the yarn exerts a tilting moment on the traveler (in the clockwise direction in FIG. 1), the contact, and hence the friction, between the traveler and the ring both in the region 6 of the lower arm and in the lower part of the region 4 of the main body section is intensified, the effects of which are sufficiently adverse as to negate at least partially the benefits resulting from the opposition between the forces 9 and 11.

The indicated loads and forces 8 (10), 11 and 21 nevertheless are successfully counteracted in substantial measure through a special design, in accordance with the present invention, of the cross-sectional configurations of the various sections of the traveler 1.

For this purpose, the main body section 12 is provided with a lift-generating profile or cross-sectional configuration, designated 12*a* in FIG. 2, which is generally oblong, and more particularly airfoil-like, in shape and has a relatively wider or blunt end 14 at the leading edge of the section (as viewed with respect to the direction of movement 15 of the traveler along the ring) and a relatively narrower or less blunt end 13 at the trailing edge of the section. As a result, there is generated in this region of the traveler a lift or buoyancy force 16 tending to displace the traveler radially inwardly of and thus off the inside face of the ring. Correspondingly, the two transverse arms 17 and 22 extending, respectively, over and under the ring 2 also have a lift-generating profile or cross-sectional configuration, designated 17*a* and 22*a* in FIGS. 3 and 4, which is generally oblong, and more particularly airfoil-like, in shape and has in the one case a more blunt leading edge 18 and a less blunt trailing edge 19, and in the other case a more blunt leading edge 25 and a less blunt trailing edge 24. Both of these profiles are similarly oriented so that, with respect to the direction of movement 15, the upper arm generates a downwardly directed lift force designated by the arrow 20, while the lower arm generates a downwardly directed lift force designated by the arrow 23. Both of these forces thus are directed counter to the yarn force component 10, so that the combined lift generated by the two arms substantially relieves the region 6 of the lower arm from the retarding effects of friction at the underside of the ring. As shown, the cross-sectional configuration 22*a* of the lower arm may be smaller than the cross-sectional configuration 17*a* of the upper arm.

The transition sections of the travelers, by way of contrast to the main body section 12 and the arms 17 and 22, can have any profile or cross-sectional configuration that is aerodynamically favorable, i.e. streamlined, but is neutral as far as lift generation is concerned. Such a construction is illustrated in FIG. 7 which, in the first instance, shows the cross-sectional configuration of the transitional section 26*a* between the body section 12 and the upper arm 17. As before, the cross-sectional configuration is generally oblong in shape and has a more blunt leading edge 29 and a less blunt trailing edge 30, but its particular shape is now drop-like and essentially symmetrical with respect to a longitudinal dividing line designated by the dot-dash line 28. As indicated by the numerals in parentheses, the other transition sections 26*b*, 26*c* and 26*d* of the traveler can, and normally will, have the same drop-shaped profile, but it will be understood that the cross-sectional configuration of any given transition section can differ in size and shape from the one illustrated in FIG. 7, if such a difference is dictated by the cross-sectional configurations of the respective adjoining sections of the traveler. The only invariable requirement for the transition sections is that, apart from being streamlined, i.e. as aerodynamically favorable as possible, they should be neutral insofar as lift generation is concerned.

In like manner, the hook ends or arm extremities 31 and 36 which engage the ring 2 at the outside may have a profile or cross-sectional configuration which is drop-shaped and hence neutral. As shown in FIGS. 5 and 6, however, the cross-sectional configurations, designated 31*a* and 36*a*, of the arm extremities or hook ends may be, and preferably are, airfoil-shaped so as to be able to generate codirectional lift forces, indicated by the arrows 34 and 38, which would be added to and supplement the lift force 16 generated by the main body section 12 of the traveler. In either case, of course, the cross-sectional configurations of the hook ends will be generally oblong in shape with a relatively wider or blunt leading edge, designated 32 in FIG. 5 and 37 in FIG. 6, and a relatively narrower or less blunt trailing edge, designated 33 in FIG. 5 and 39 in FIG. 6.

As a further refinement of the traveler construction in accordance with the present invention, the main body section thereof can also be made in such a way that the lift force generated thereby and directed toward the center of the ring 2 will be greater in the lower region of the traveler than in its upper region, thereby to provide as well an effective counteraction to the tilting moment generated by the yarn tension. At all times, of course, care must be taken that the lift forces 20 and 23 remain effective to counter the vertical component 10 of the yarn tension.

It will be understood that the foregoing description of preferred embodiments of the present invention is for purposes of illustration only, and that the various structural and operational features and relationships herein disclosed are susceptible to a number of modifications and changes none of which entails any depature from the spirit and scope of the present invention as defined in the hereto appended claims. Thus, the extent of asymmetry of the airfoil-shaped cross-sectional configurations with respect to the respective longitudinal dividing lines thereof shown in FIGS. 2 to 6 may be varied as desired as long as the larger parts of the sections 12*a*, 31*a* and 36*a* face inwardly of the ring and the larger parts of the sections 17*a* and 22*a* face downwardly of the ring. Also, although the longitudinal dividing lines of the various sections are shown as being oriented in the direction of movement, the sections could be constructed so as to provide for a suitable angle of attack other than 0°.

What is claimed is:

1. An ear-shaped ring traveler designed for movement in only one given direction along a ring of a yarn twister or like machine, a. said traveler having a main body section, first and second transition sections at the opposite ends of said main body section, respectively, first and second arms extending generally codirectionally from said first and second transition sections, respectively, third and fourth transition sections at the ends of said first and second arms remote from said main body section, respectively, and first and second hook-like ends extending mutually inwardly toward one another from said third and fourth transition sections, respectively, b. of which, when the traveler is in use, said main body section extends generally vertically across and moves translationally along the inside face of the ring, said first and second arms extend generally horizontally outwardly across and move translationally along the upper and lower edges of the ring, respectively, said first and second hook-like ends extend downwardly and upwardly, respectively, over and move translationally along the outside face of the ring, and said first transition section at its inside surface defines a guide for the yarn being twisted, c. said traveler having aerodynamically streamlined cross-sectional contours throughout, d. the cross-sectional configuration of any part of said traveler on a transverse plane perpendicular to the longitudinal dimension of the respective part being generally oblong in shape and having, as viewed with reference to said given direction of movement, a relatively blunt leading edge and a relatively less blunt trailing edge, e. said cross-sectional configuration of said main body section being airfoil-shaped and oriented, with reference to said given direction of movement, so as to generate, when the traveler is in use, a lift force directed oppositely to and counteracting the centrifugal forces exerted on said traveler, thereby to urge said main body section out of frictional engagement with the inside face of the ring, and f. said cross-sectional configuration of each of said arms being airfoil-shaped and oriented, with reference to said given direction of movement, so as to generate respective codirectional lift forces directed downwardly with respect to the ring oppositely to and counteracting the upward component of the yarn force, thereby to urge said lower arm out of frictional engagement with the lower edge of the ring.

2. A traveler as claimed in claim 1, wherein each of said airfoil-shaped configurations is asymmetrical with respect to a respective longitudinal dividing line extending from said leading edge to said trailing edge, with the larger part of said cross-sectional configuration of said main body section being located to the side of the respective longitudinal dividing line facing toward the middle of the ring when the traveler is in use, with the larger part of said cross-sectional configuration of said first arm being located to the side of the respective longitudinal dividing line facing toward the upper edge of the ring, and with the larger part of said cross-sectional configuration of said second arm being located to the side of the respective longitudinal dividing line facing away from the lower edge of the ring.

3. A traveler as claimed in claim 1, wherein the cross-sectional configurations of at least said first and second transition sections are neutral with respect to generation of lift forces.

4. A traveler as claimed in claim 1, wherein the cross-sectional configurations of said transition sections are neutral with respect to generation of lift forces.

5. A traveler as claimed in claim 1, wherein the cross-sectional configuration of each of said transition sections is drop-shaped and symmetrical with respect to a longitudinal dividing line extending from said leading edge to said trailing edge.

6. A traveler as claimed in claim 1, wherein the cross-sectional configuration of each of said hook-like ends is airfoil-shaped and oriented, with reference to said given direction of movement, so as to generate, when the traveler is in use, respective codirectional lift forces directed inwardly of the ring and supplementing said lift force generated by said main body section in opposing the effects of centrifugal force.

7. A traveler as claimed in claim 1, wherein the cross-sectional configuration of each of said hook-like ends is neutral with respect to generation of lift forces.

8. A traveler as claimed in claim 1, wherein the cross-sectional configuration of each of said hook-like ends is drop-shaped and symmetrical with respect to a longitudinal dividing line extending from said leading edge to said trailing edge.

9. A traveler as claimed in claim 1, wherein said airfoil-shaped cross-sectional configuration of said main body section in the lower half thereof is designed to generate a greater lift force than said airfoil-shaped cross-sectional configuration of said main body section in the upper half thereof, thereby to counteract the tilting moment exerted on the traveler by the yarn.

* * * * *